US007182543B2

(12) United States Patent
Kondo et al.

(10) Patent No.: US 7,182,543 B2
(45) Date of Patent: Feb. 27, 2007

(54) JOINING STRUCTURE

(75) Inventors: Tetsumi Kondo, Chiyoda-ku (JP); Masakazu Sugimoto, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/896,508

(22) Filed: Jul. 22, 2004

(65) Prior Publication Data

US 2005/0028478 A1 Feb. 10, 2005

(30) Foreign Application Priority Data

Jul. 22, 2003 (JP) ..... 2003-199723

(51) Int. Cl.
*F16B 7/00* (2006.01)
*F16B 9/00* (2006.01)

(52) U.S. Cl. ..... 403/41; 403/42; 403/270

(58) Field of Classification Search ..... 403/270–272, 403/190, 187, 188, 192, 41, 335, 231, 242, 403/400, 346

See application file for complete search history.

(56) References Cited

U.S. PATENT DOCUMENTS 4,219,285 A * 8/1980 Hayashi ..... 403/188
4,746,056 A * 5/1988 Thomsen ..... 228/170
5,205,529 A * 4/1993 Killian ..... 248/636
5,481,835 A * 1/1996 Bloom ..... 52/98
5,853,651 A * 12/1998 Lindsay et al. ..... 264/512
6,368,424 B1 4/2002 Sakai et al. ..... 148/111
6,379,074 B1 * 4/2002 Chin et al. ..... 403/231
6,668,417 B1 * 12/2003 Slattery ..... 15/235.4
6,726,170 B2 * 4/2004 Luo ..... 248/538
6,857,808 B1 * 2/2005 Sugimoto et al. ..... 403/41
6,896,437 B2 * 5/2005 Morgan et al. ..... 403/188

FOREIGN PATENT DOCUMENTS

JP 01132102 5/2001
JP 03001476 1/2003

* cited by examiner

*Primary Examiner*—Daniel P. Stodola
*Assistant Examiner*—Joshua T. Kennedy
(74) *Attorney, Agent, or Firm*—Baker Botts LLP

(57) ABSTRACT

A structure is provided between a first columnar structural member and at least a second structural member in which the stress concentration at the fixed end portion of the reinforcing member with the first columnar structural member and the second structural member(s) is greatly relaxed. Also, in the case where the reinforcing member is welded, the residual welding stress is relaxed, with the result that the proof stress and the fatigue performance are remarkably improved over the prior art. In the joining structure with the first columnar structural member and the second structural member(s), the first columnar structural member and the second structural member(s) joined to each other have welded thereto at least a tabular reinforcing member to reinforce the joining of the structural members. The reinforcing member has a U- or V-shaped bent portion along the surface of the structural members and also an opening.

22 Claims, 10 Drawing Sheets

Prior Art

Prior Art

JOINING STRUCTURE

CROSS-REFERENCE TO RELATED APPLICATION(S)

The present application claims priority under 35 U.S.C. § 119 from Japanese Patent Application No. 2003-199723, filed on Jul. 22, 2003, the entire disclosure of which is incorporated herein by reference.

FIELD OF THE INVENTION

The present invention relates to a joining structure, and more particularly to the joining structure that is adapted to be arranged between a first columnar structural member and a second structural member.

BACKGROUND INFORMATION

Conventionally, a joining structure formed as a tabular reinforcing member or a U- or V-shaped reinforcing member, may be welded between a first columnar steel structural member and second structural member (such as a first columnar structural member crossing a tabular structural member or second columnar structural member—for example, see Japanese Patent Publication Nos. 2001-132102 and 2003-001476, the entire disclosures of which are incorporated herein by reference).

FIG. 8 shows a conventional joining structure in which tabular reinforcing members 12 are joined by welding between these structures a first columnar steel structural member 10 and a second structural member 11, and the bending moment of the second structural member 11 is exerted on the first columnar structural member 10. A large stress is concentrated on the first columnar structural member 10 near to the fixed end portions 14 of the tabular reinforcing members 12, thereby likely posing a problem of a reduced structural performance. Further, in the case where the tabular reinforcing members 12 are welded to the first columnar structural member 10, the boxing portion at the upper end portion of each tabular reinforcing member 12 may develop a structural defect due to the double effects of the residual welding stress and deterioration of the material of the thermally affected member at the welding fixed end portions, thus posing a problem of a reduced proof stress and a reduced fatigue performance.

FIG. 9 shows another conventional joining structure with U- or V-shaped reinforcing members 13 welded between a first columnar steel structural member 10 and a second structural member 11. In this conventional structure, the joining portion between the first columnar structural member 10 and each reinforcing member 13 has a U- or V-shape along the surface of the first columnar structural member 10. In the case where a large bending moment or axial force is exerted on the first columnar structural member 10, a large stress concentration acting on the first columnar structural member 10 near the U- or V-shaped fixed end portions 15 of the reinforcing members 13 welded to the first columnar structural member 10 may be greatly relaxed. In the case where the U- or V-shaped reinforcing members 13 are welded to the first columnar structural member 10, the residual welding stress as well as the stress concentration at the fixed end portions 15 can be also greatly relaxed.

At the joining portion between the open end 16 of each U- or V-shaped reinforcing member 13 and the second structural member 11, a large stress concentration may occurs on the second structural member 11 in the vicinity of the fixed end portions of the open ends 16 of the U- or V-shaped reinforcing members 13 when the bending moment is exerted on the first columnar structural member 10, thereby likely leading to a problem of a reduced structural performance. Further, in the case where the open end portion 16 of each U- or V-shaped reinforcing member 13 is welded to the second structural member 11, the boxing portion of the open end of the U or V-shaped reinforcing member 13 may develop a structural defect due to the double effects of the residual welding stress and the deterioration of the material of the thermally-affected portion at the fixed end portion, thus posing the problem of a reduced proof stress and fatigue performance.

SUMMARY OF THE INVENTION

One of the objects of the present invention is to solve the above-described problems of conventional joining structures, and to provide a joining structure between a first columnar structural member and a second structural member, in which the stress concentration at the fixed end portion of each reinforcing member with the first columnar structural member and the second structural member and the residual tensile welding stress of the reinforcing member welded are greatly reduced or relaxed. Thus, the result of such exemplary configuration is that the proof stress and the fatigue performance are likely greatly improved over the conventional joining structures.

According to a first exemplary embodiment of the present invention, a joining structure is provided with a first columnar structural member joined to a second structural member, In particular, at least a tabular reinforcing member (provided for reinforcing the joining portion of the first columnar structural member and the second structural member) is welded to the first columnar structural member and the second structural member to be joined. In addition, the reinforcing member has at least two U- or V-shaped bent portions along the surface of the first columnar structural member and the second structural member, and includes at least an opening.

According to a second exemplary embodiment of the present invention, the joining structure includes a first columnar structural member joined to a second structural member, and a reinforcing member welded to the first columnar structural member and the second structural member. The reinforcing member is protruded from the surface of the first columnar structural member and the structural member, and has a bent portion with a U- or V-shaped cross section along the surface of the first columnar structural member and the second structural member on the side of the reinforcing member far from the joining portion of the first columnar structural member and the second structural member. At least the bent portion can be welded to the first columnar structural member and the second structural member, and the reinforcing member has an opening on the side thereof not in contact with the first columnar structural member and the second structural member.

According to a third exemplary embodiment of the present invention, the opening is arranged in an end surface formed by the end portion of the reinforcing member that is not in contact with (or disconnected from) the first columnar structural member and the second structural member. The opening may be a space formed by the inner edge of the reinforcing member.

According to a fourth exemplary embodiment of the present invention, the opening is arranged in an end surface formed by the end portion of the reinforcing member that is not in contact with (or disconnected from) the first columnar structural member and the second structural member. The long diameter of the opening may be from 0.5 to less than 1.0 times as large as the long diameter of the end surface.

According to a fifth exemplary embodiment of the present invention, the joining structure includes a first columnar structural member joined to a plurality of second structural members and a reinforcing member welded to two of the second columnar structural members. The reinforcing member may be protruded from the surface of the two second columnar structural members, and has a bent portion with a U- or V-shaped cross section along the surface of the two second columnar structural members on the side of the reinforcing member at a substantial distance from the joining portion of the two second columnar structural members and the first columnar structural member. The bent portion may be welded to the two second columnar structural members I and the reinforcing member has an opening on the side thereof not in contact with (or disconnected from) the two second columnar structural members and the first columnar structural member.

According to a sixth exemplary embodiment of the present invention, the opening is arranged in an end surface formed by the end portion of the reinforcing member not in contact with the two second columnar structural members and the first columnar structural member and that the opening is a space formed by the inner edge of the reinforcing member.

According to a seventh exemplary embodiment of the present invention, the opening is arranged in an end surface formed by the end portion of the reinforcing member not in contact with (or disconnected from) the two second columnar structural members and the first columnar structural member. The long diameter of the opening is from 0.5 to less than 1.0 times as large as the long diameter of the end surface.

According to an eighth exemplary embodiment of the present invention, the second structural member may be a tabular member.

According to a ninth exemplary embodiment of the present invention, the second structural member can be a columnar member crossing the first columnar structural member.

According to a tenth exemplary embodiment of the present invention, the width of the reinforcing member is from 0.7 to 0.95 times as large as the width of the first columnar structural member. The reinforcing members may be arranged only at opposed positions with respect to the first columnar structural member.

According to an eleventh exemplary embodiment of the present invention, the width of the reinforcing member is from 0.7 to 0.95 times as large as the width of the second columnar structural members.

According to a twelfth exemplary embodiment of the present invention, a lid member may be arranged on the opening.

According to a thirteenth exemplary embodiment of the present invention, the reinforcing member may be produced by forming and welding two or more tabular members to each other.

According to a fourteenth exemplary embodiment of the present invention, the reinforcing member may be formed from a cylindrical member.

In the joining structure according to an exemplary variant of the present invention, the end joining portions between the reinforcing member having an opening and the first columnar structural member and the second structural member may be bent into a U- or V-shape in the direction away from the direction of main stress of the first columnar structural member and the second structural member, respectively. Therefore, the end joining portions of the reinforcing member can have a low rigidity structure. As a result, both the stress concentration at the end joining portions between the reinforcing member and the first columnar structural member and the second structural member and the residual welding stress of the weld zone can be considerably relaxed, thereby making it possible to greatly improve the proof stress and the fatigue performance of the joining structure.

The reinforcing members, with the width thereof set close to the width of the first columnar structural member, may be arranged only at a pair of opposed positions with respect to the first columnar structural member. In this way, even in the case where the width of one side of the tabular structural member, such as a base plate, is limited spatially and it is geometrically difficult to arrange four reinforcing members at pitches of 90 degrees, the reinforcing member according to the invention can secure a large second moment of area and a large modulus of section while at the same time improving the fatigue resistance performance remarkably, thereby making it possible to reduce the materials cost and the construction cost.

By arranging the lid member on the opening of the reinforcing member, the intrusion of rain water or dust and dirt into the opening is prevented, on the one hand, and the corrosion of the reinforcing member and the structural members may be suppressed at the same time.

BRIEF DESCRIPTION OF THE DRAWINGS

FIG. 2(*b*) is a plan view of the joining structure of yet another exemplary embodiment of the present invention.

FIG. 3(*b*) is a perspective view of the joining structure according to yet another exemplary embodiment of the present invention.

FIG. 4(*b*) is a perspective view the joining structure according to still another exemplary embodiment of the present invention.

FIG. 6(*b*) is a perspective view of the reinforcement member fabricated using another exemplary embodiment of the method according to the present invention.

FIG. 6(*c*) is a perspective view of the reinforcement member which includes four tabular members fabricated using another exemplary embodiment of the method according to the present invention.

DETAILED DESCRIPTION

Figure 1:
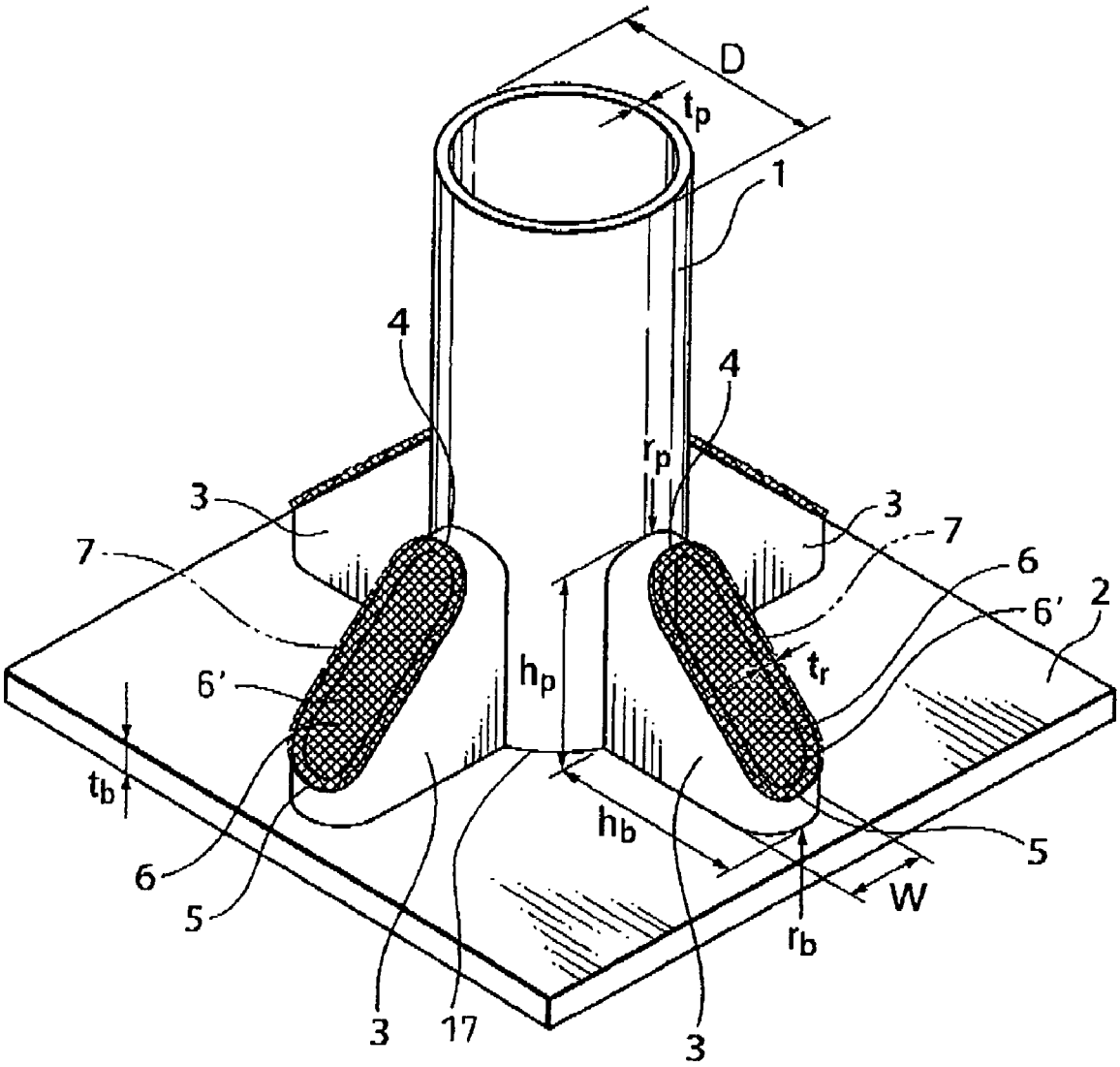
FIG. 1 is a perspective view of a joining structure according to one exemplary embodiment of the present invention.
Figure 2A:
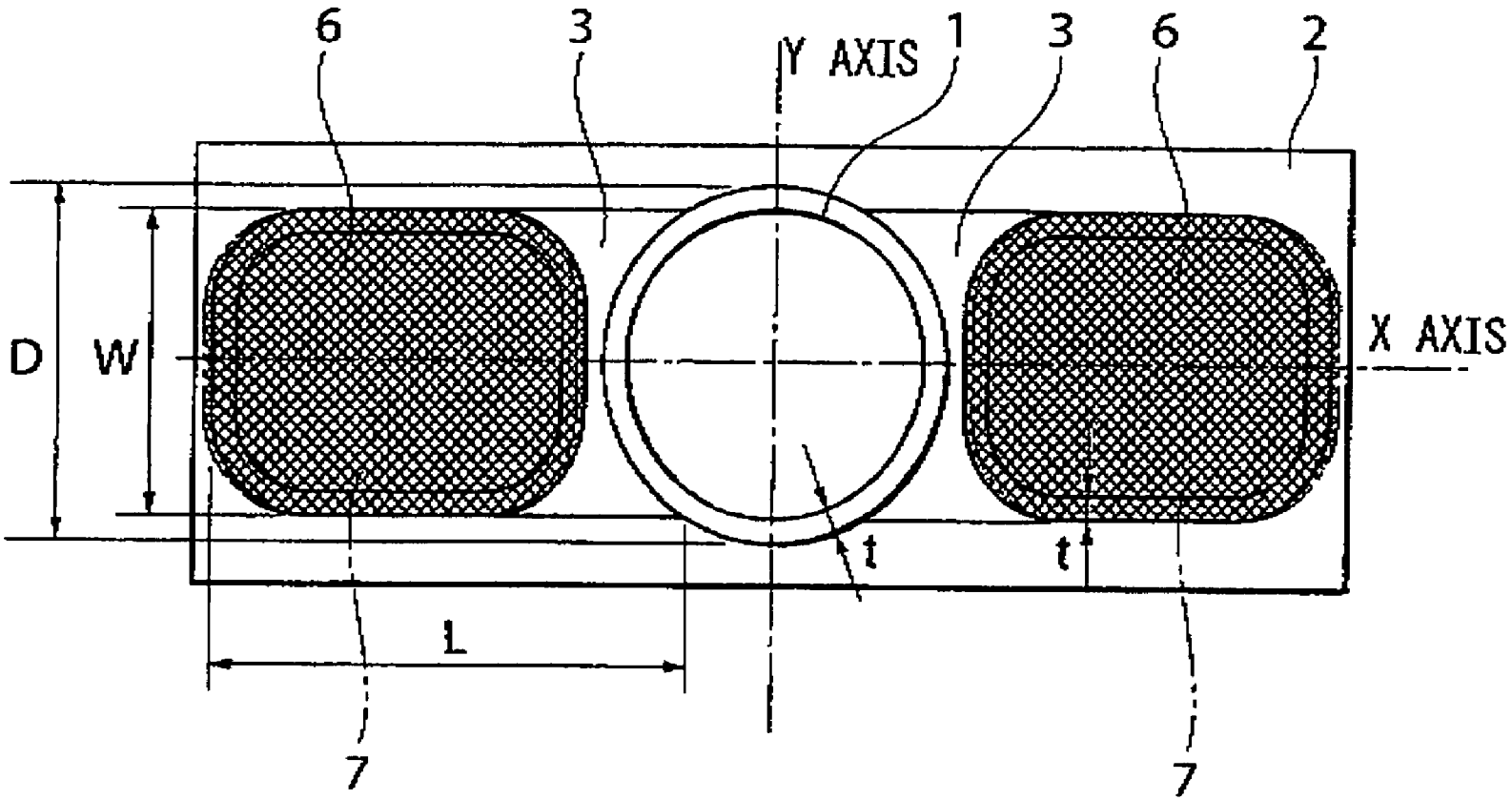
FIG. 2(*a*) is a plan view of the joining structure of another exemplary embodiment of the present invention.
Figure 2B:
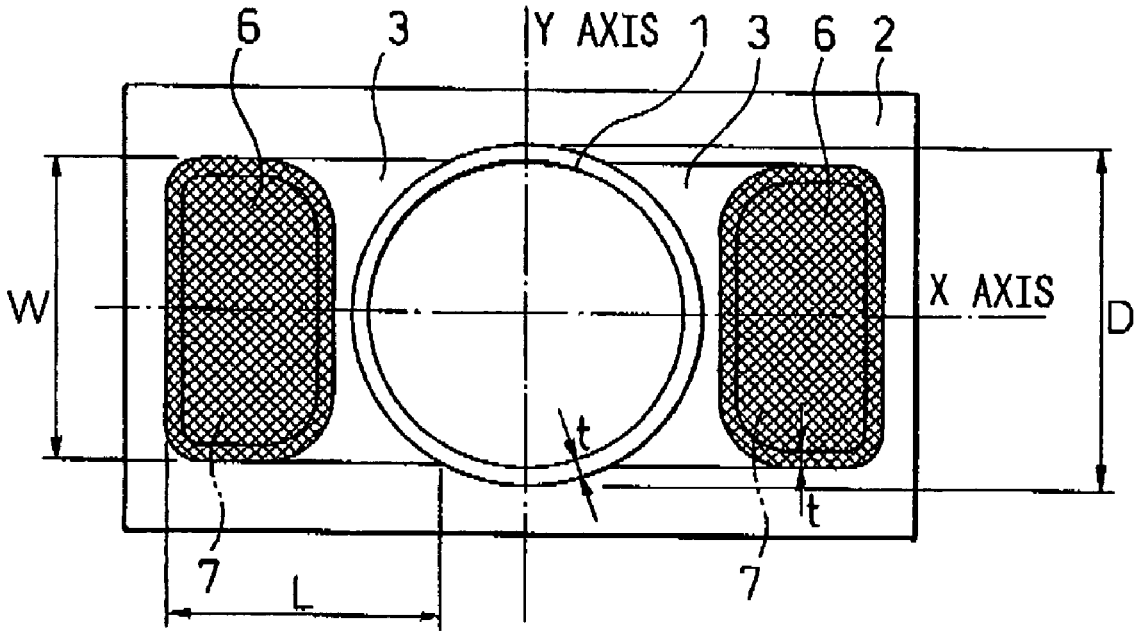
Figure 3A:
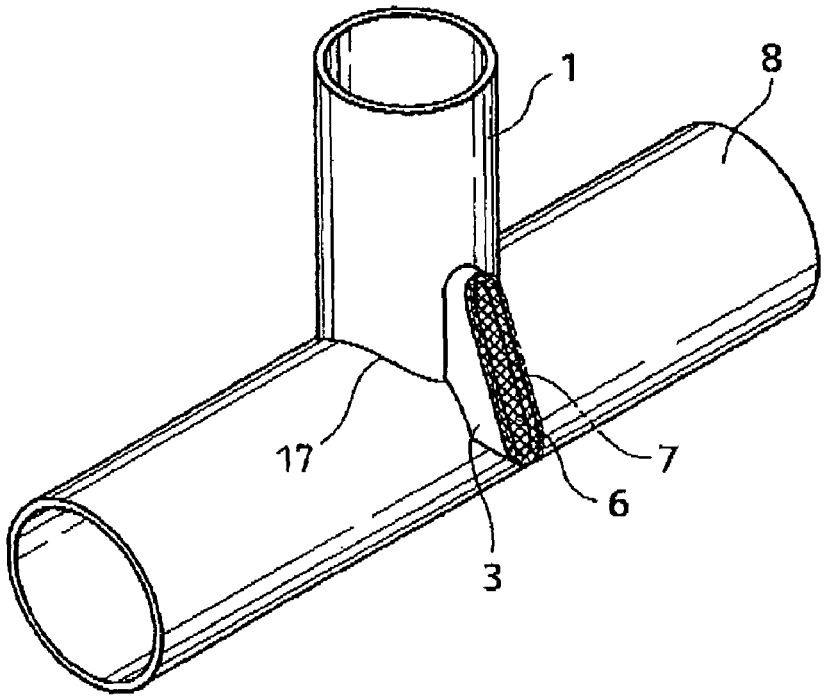
FIG. 3(*a*) is a perspective view of the joining structure according to still another exemplary embodiment of the present invention.
Figure 3B:
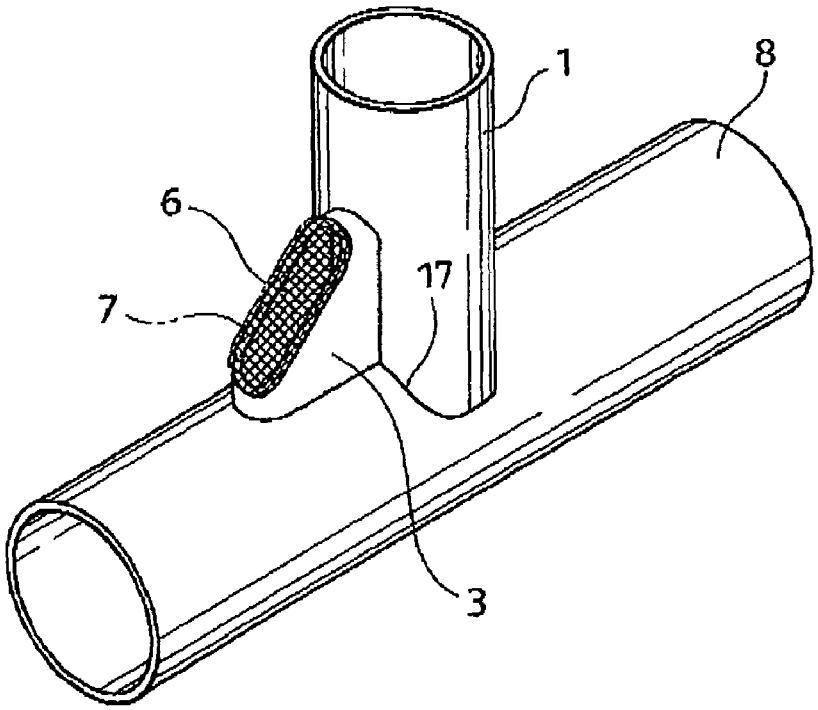
Figure 4A:
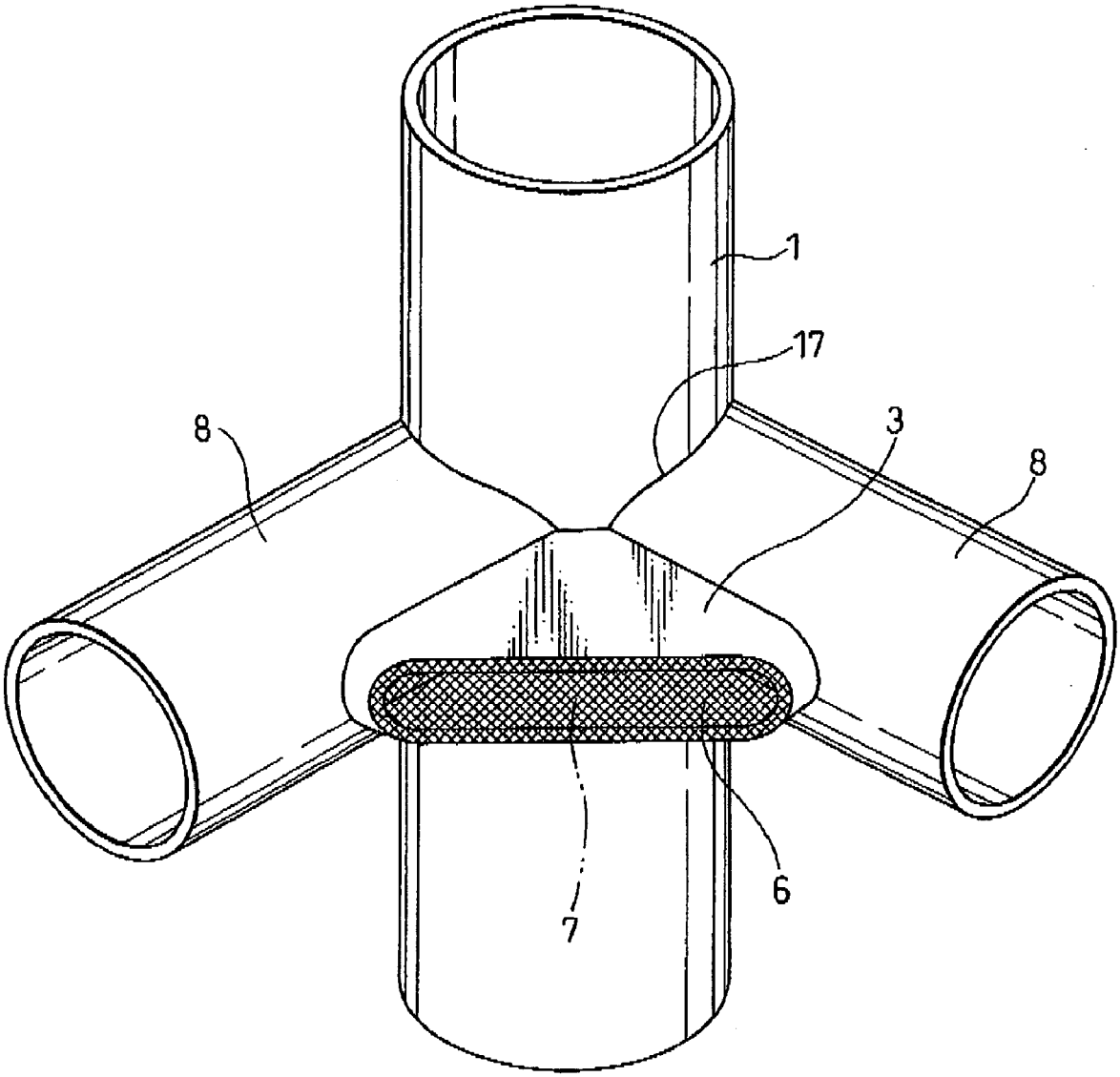
FIG. 4(*a*) is a perspective view of the joining structure according to still another exemplary embodiment of the present invention.
Figure 4B:
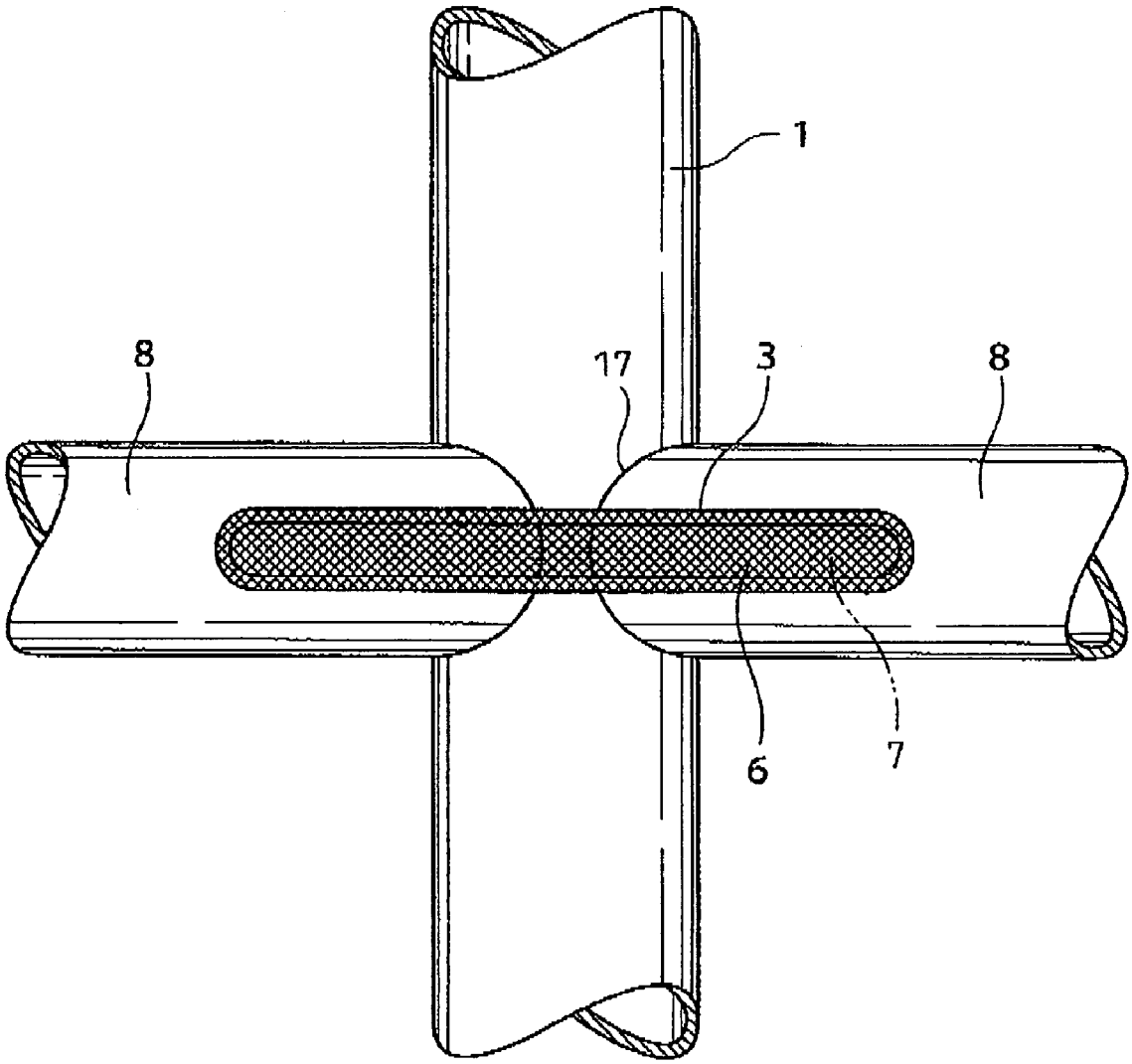

FIG. 1 is a perspective view showing a joining structure according to one exemplary embodiment of the present invention in which four reinforcing members are arranged at intervals of approximately 90 degrees between a first columnar structural member and a tabular structural member constituting a second structural member. FIGS. 2(*a*), 2(*b*) are a plan view showing a joining structure in which two reinforcing members are arranged at intervals of 180 degrees between a first columnar structural member and a tabular structural member. FIGS. 3(*a*), 3(*b*) are perspective views showing a joining structure in which a reinforcing member is arranged between a first columnar structural member and a second columnar structural member crossing the first columnar structural member. FIG. 4 is a perspective view showing a joining structure in which a reinforcing member is arranged between a first columnar structural member and a plurality of second columnar structural members.

Figure 5:
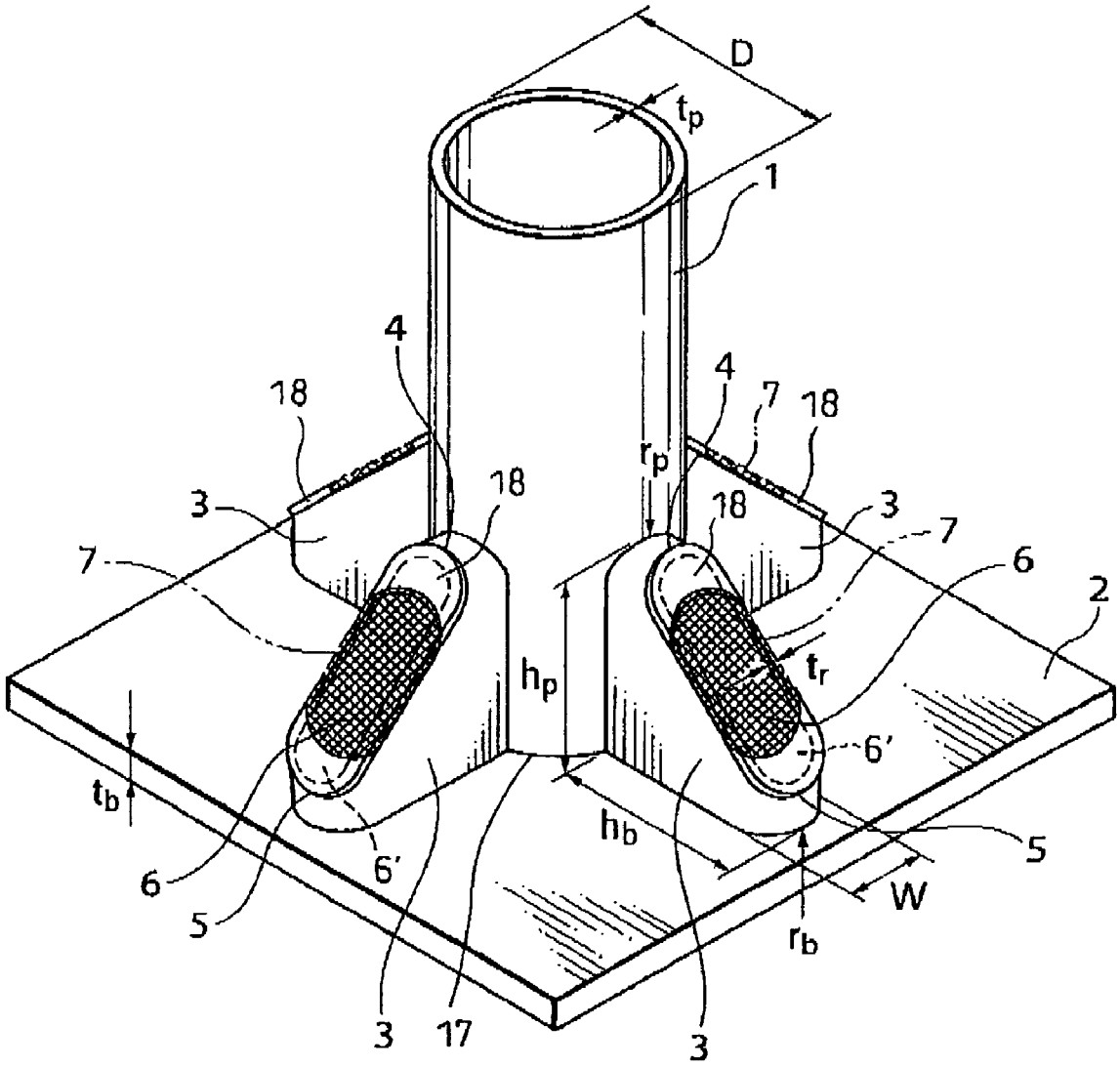
FIG. 5 is a perspective view the joining structure according to still another exemplary embodiment of the present invention in which a part of the opening of the reinforcing member shown in FIG. 1 is closed.
Figure 6A:
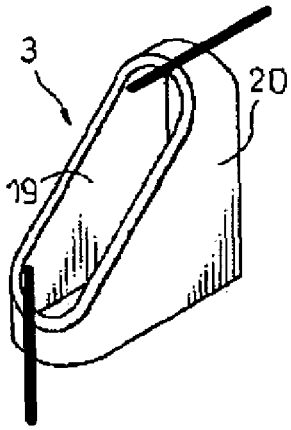
FIG. 6(*a*) is a perspective view of the reinforcing member according to an exemplary embodiment of the present invention which includes two tabular members fabricated by an exemplary embodiment of a method according to the present invention.
Figure 6B:
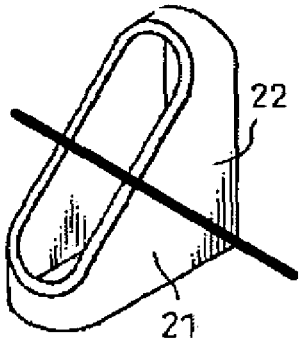
Figure 6C:
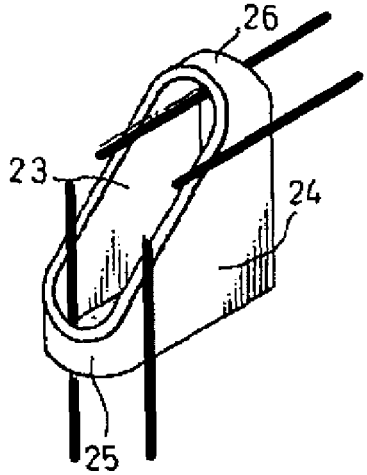
Figure 7:
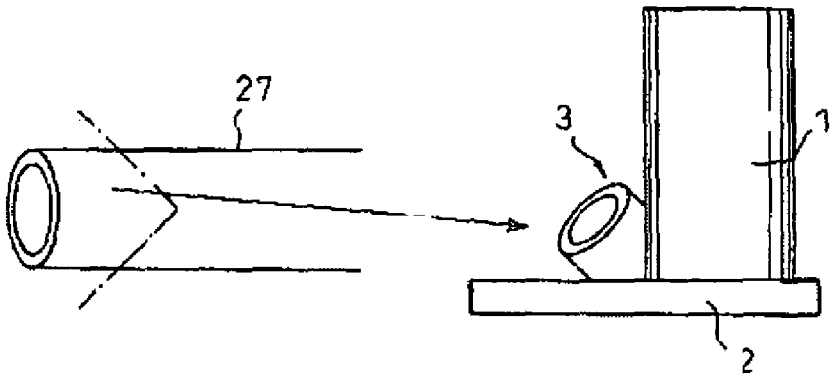
FIG. 7 is a perspective view showing another exemplary embodiment of the method for fabricating the reinforcing member that includes a cylindrical member.
Figure 8:
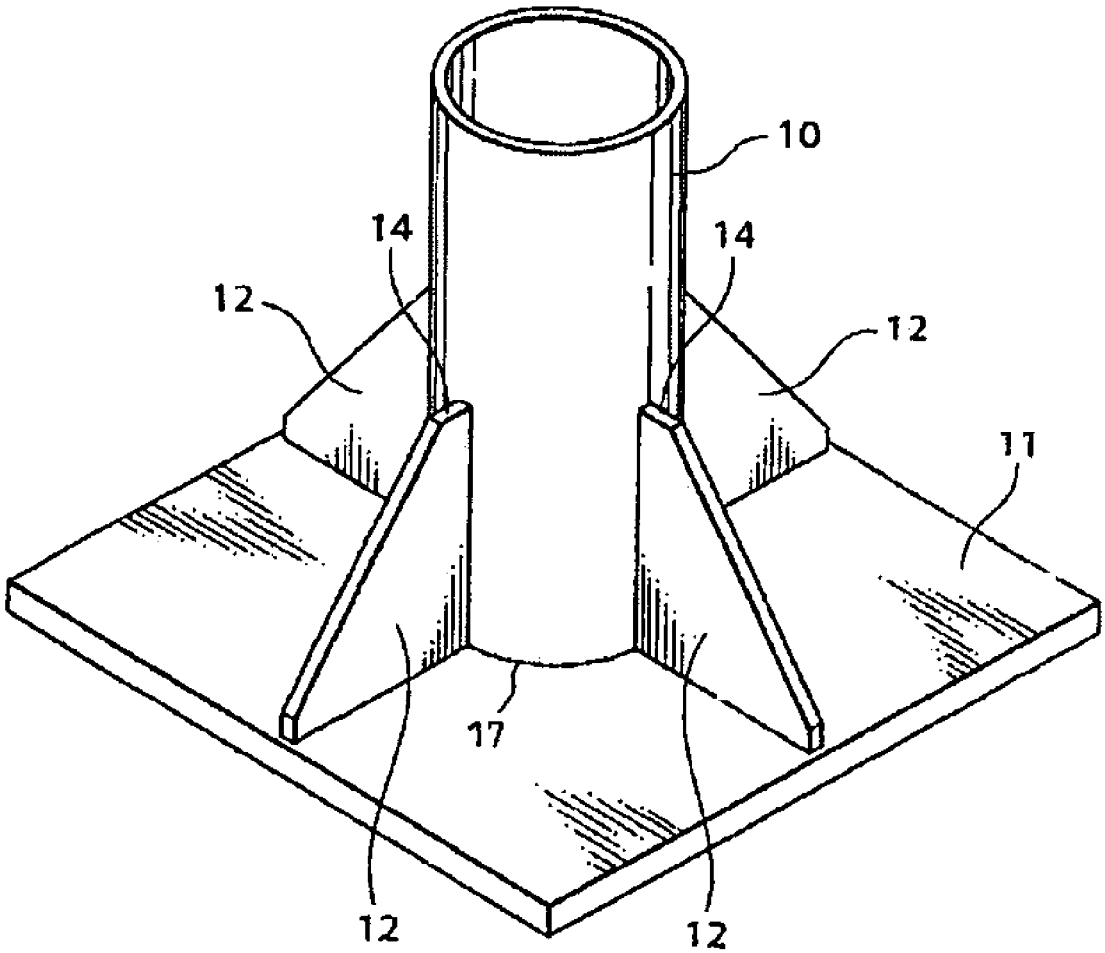
FIG. 8 is a perspective view of the conventional joining structure.

FIG. 5 is a perspective view showing a joining structure in which a part of the opening of each of the reinforcing members in FIG. 1 is closed. FIGS. 6(*a*), 6(*b*), 6(*c*) are perspective views showing examples of the reinforcing member by welding at least two tabular members obtained by forming. FIG. 7 is a perspective view showing a method of fabricating the reinforcing member configured as a cylindrical member obtained by forming.

In the joining structure according to the exemplary embodiment shown in FIG. 1, reference numeral 1 designates a first columnar structural member, numeral 2 designates a tabular structural member constituting a second structural member welded to the lower end of the first columnar structural member 1, and numeral 3 designates reinforcing members welded at intervals of 90 degrees between the first columnar structural member 1 and the tabular structural member 2 and formed in such a manner as to be projected from the first columnar structural member 1 and the tabular structural member 2. At the end portion of each reinforcing member 3 welded to the first columnar structural member 1 (which is provided at a distance from a joining portion 17 between the first columnar structural member 1 and the tabular structural member 2, i.e., at an upper end portion 4, the cross section of the reinforcing member 3 along the surface of the first columnar structural member 1 is curved into a U- or V-shape. Also, at that end portion of the reinforcing member 3 welded to the tabular structural member 2 (which is provided at a distance from the joining portion 17), between the first columnar structural member 1 and the tabular structural member 2, i.e., at the lower end portion 4, the cross section of the reinforcing member 3 along the surface of the tabular structural member 2 is curved into a D- or V-shape. Such curved portions at the upper and lower end portions of each reinforcing member 3 form an opening 6 constituting a space not including the thickness t r of the reinforcing member 3 on the side thereof that is not in contact with the first columnar member 1 and the tabular member 2.

Specifically, the opening 6 is a space formed by the inner edge of the reinforcing member 3 defined by the end portions thereof not in contact with the first columnar structural member 1 and the tabular structural member 2 in FIG. 1. Also, in FIG. 1, the end surface 6' is an end surface formed by the side of the end portions of the reinforcing member 3 not in contact with the columnar structural member 1 and the tabular structural member 2, and includes the thickness t r of the reinforcing member 3. Generally, the opening 6 and the end surface 6' form an elliptic shape having a long diameter and a short diameter. According to this exemplary embodiment of the present invention, the size of the opening 6 may be equal to the size of an end surface 6' less the thickness $t_r$ of the reinforcing member 3. In the joining structure according to this exemplary embodiment, the upper and lower end portions 4, 5 of the reinforcing member 3 may be bent into a U- or V-shape in the direction away from the main stress of the first columnar structural member 1 and the tabular structural member 2. Therefore, the upper and lower end portions of each reinforcing member 3 can be formed as a low-rigidity structure.

As a result, the stress concentration in the upper and lower end portions 4, 5 of the reinforcing member 3 and the residual welding stress of the weld zone are greatly relaxed for a remarkably improved proof stress and fatigue performance. In order to exhibit this effect sufficiently, the radius of curvature of the bent portions of the upper and lower end portions 4, 5 of the reinforcing member 3 is preferably at least three times as large as the thickness of the reinforcing member 3. A smaller radius of curvature may cause the material deterioration when bending the reinforcing member 3, and reduce the rigidity to a lesser degree. The reinforcing members 3 may be welded to the first columnar structural member 1 and the tabular structural member 2 on the outside of the reinforcing members 3, and may be preferably welded from both the inside and the outside of the reinforcing member 3.

Additionally, in order to avoid the superposed relation between the reinforcing member 3 and the weld zone between the first columnar structural member 1 and the tabular structural member 2, a scallop may be arranged at the part of the reinforcing member 3 corresponding to the weld zone 17 between the first columnar structural member 1 and the tabular structural member 2, i.e. at the inside corner of the reinforcing member 3 on the side far from the opening. The opening 6 of each reinforcing member 3 is desirably covered by a lid member 7 to shut out rain water and dust and dirt (designated by a network in FIG. 1). In the case where the thickness of the lid member 7 is not larger than the thickness of the reinforcing member 3, the stress acting on the reinforcing member 3 is relaxed. The thickness of the lid member 7 is preferably not more than 0.5 times as large as the thickness of the reinforcing member 3. Also, the material of the lid member 7 is preferably milder than that of the reinforcing members 3. In place of the lid member 7, a filler such as foamed resin may be filled into the opening.

In the joining structure according to other exemplary embodiments of the present invention shown in FIGS. 2(*a*) and 2(*b*), a narrow tabular structural member 2 may be welded to the lower end of the first columnar structural member 1. A reinforcing member similar to the reinforcement member provided in the exemplary embodiment shown in FIG. 1 may be arranged by being welded only at opposite positions with respect to the first columnar structural member 1 between the first columnar structural member 1 and the narrow tabular structural member 2. FIG. 2(*a*) shows the embodiment in which the tabular structural member 2 has a strict restriction for width along Y-axis direction and mild restriction for width along X-axis. FIG. 2(*b*) shows the embodiment in which the tabular structural member 2 has a strict restriction for width in both directions where the width along X-axis, is not more than 3 times as long as outer diameter of the first columnar structural member section. For the embodiment shown in FIG. 2(*b*), the width W of the reinforcing member 3, i.e., the length along the direction (e.g., Y direction) that is orthogonal to the axis connecting the center of the reinforcing member 3 and the center of the first columnar structural member 1 can approximately be the width of the first columnar structural member 1, or preferably at least 70% of the width of the first columnar structural member 1. Considering formability of the joining structure, the preferable upper limit of the width W of the reinforcing member 3 may be 95% of the width of the first columnar structural member 1. In addition, the lid member 7 may preferably be arranged on the opening 6 of the reinforcing member 3.

The reinforcing members 3 arranged only at positions opposite to each other with respect to the first columnar structural member 1 may be designed to secure a sufficient rigidity and a sufficient strength against the bending moment about the X axis along the crossing line between the center line surface of the reinforcing member 3 and the surface of the tabular structural member 2 and the bending moment about the Y axis orthogonal to the X axis. In order to meet the bending moment about the Y axis, a preferable amount of the thickness t and the extension L of each reinforcing member 3 may be secured. Therefore, even a narrow tabular structural member 2 such as a base plate can potentially meet this purpose.

In order to meet the bending moment about X axis with the narrow tabular structural member 2, in which case the reinforcing member 3 is preferably not arranged along the transverse direction (Y direction), the width (e.g., the "holding" width) W of the reinforcing member 3 can be desirably increased.

The width (the holding width) W of the reinforcing member 3 as shown in the exemplary embodiments of FIGS. 2(*a*) and 2(*b*) may be defined as the maximum width along Y axis of the part of the reinforcing member 3 welded to the tabular structural member 2.

In the case where the columnar structural member 1 is formed from a circular steel pipe, D may be identified as the diameter, e.g., the width of the columnar structural member 1, and t may be identified as the thickness thereof. Then, the second moment of area $I_1$ and the modulus of section $Z_1$ are expressed as $$I_1=(\pi/64)\times\{D^4-(D-2\cdot t)^4\}=(\pi/8)\times D^3\cdot t$$

$$Z_1=(\pi/32)\times\{D^3-(D-2\cdot t)^3\}=(\pi/4)\times D^2\cdot t$$

On the other hand, the second moment of area 12 and the modulus of section $Z_2$ of the bottom surface of the reinforcing member 3 are provided as $$I_2=L\cdot W^2\cdot t$$

$$Z_2=2L\cdot W\cdot t$$

Thus, the lower limit value Wa of W to assure the equivalence of $I_2$ to $I_1$ is $$Wa=\sqrt{\{(\pi/8L)\times D^3\}}$$

The lower limit value Wb of W to assure the equivalence of $Z_2$ to $Z_1$ on the other hand, is given as $$Wb=\sqrt{(\pi/8L)\times D^2}$$

Taking into account the actual situation such as FIG. 2(*b*) where restriction for width along X-axis exists, L is often about 0.75D. Therefore, $$Wa=\sqrt{\{(\pi/6D)\times D^3\}}=0.72D$$

$$Wb=(\pi/8L)\times D^2=0.52D$$

As a result, the width W of the reinforcing member 3 may be desirably approximate to the width of the first columnar structural member 1 or from 0.7 to 0.95 times as large as the width of the columnar structural member 1.

In the joining structure according to another exemplary embodiment of the present invention shown in FIGS. 3(*a*) and 3(*b*), a second columnar structural member 8 that extends in the direction crossing the first columnar structural member 1 may be coupled to the lower end of the first columnar structural member 1, and the reinforcing member 3 similar to the one shown in FIGS. 1, 2(*a*) and 2(*b*) may be arranged between the first columnar structural member 1 and the second columnar structural member 8. In FIGS. 3(*a*) and 3(*b*), only a single reinforcing member 3 is shown. However, if more reinforcement is preferred, it is possible to add another reinforcing member 3 on the opposite side of the first columnar structural member 1. Also, the lid member 7 may be desirably arranged on the opening 6 of the reinforcing member 3.

The joining structure according to a further exemplary embodiment shown in FIGS. 4(*a*), 4(*b*) has a plurality of second columnar structural members 8 are joined at an angle to the first columnar structural member 1, and a reinforcing member 3 similar to those shown in FIGS. 1, 2(*a*), 2(*b*), 3(*a*) and 3(*b*) is arranged between the first columnar structural member 1 and the plurality of the second columnar structural members 8. For example, FIGS. 4(*a*) and 4(*b*) show exemplary arrangements with two second columnar structural members 8. The angle at which the second columnar structural members 8 cross the first columnar structural member 1 is not limited to 90 degrees but any applicable angle. The lid member 7 is preferably arranged on the opening 6 of the reinforcing member 3.

In the joining structure according to another exemplary embodiment of the present invention shown in FIG. 5, a part of each annular opening of the joining structure shown in FIG. 1 may be closed by a tabular member 18 having at least the same thickness as the reinforcing member 3. for example, the long diameter of the opening 6 of each reinforcing member 3 shown in FIG. 5 may be shorter than the long diameter of the surface formed by the end portion of the reinforcing member 3 not in contact with the first columnar structural member 1 and the second structural members 2 of the reinforcing member 3, i.e. the end surface 6'. Thus, the opening 6 may be reduced in size. In the case where the long diameter of the opening 6 is not less than 0.5 times as large as the long diameter of the end surface 6', the stress acting on each reinforcing member 3 can be relaxed. The long diameter of the opening 6 is preferably not less than 0.8 times as large as the long diameter of the end surface 6'. The ratio of the long diameter of the opening 6 to the long diameter of the end surface 6', as shown in FIG. 1, may have the maximum value in the case where the opening is not closed, and the maximum value of the ratio of the long diameter of the opening 6 to the long diameter of the end surface 6' changes with shape and thickness of the reinforcing member 3. In this case, the long diameter of the opening 6 is shorter than the long diameter of the end surface 6'.

The reinforcing member according to this invention can be formed by bending and welding two or more tabular members to each other. As shown in FIG. 6 {a), for example, the reinforcing member 3 may be fabricated in such a manner that two tabular members 19, 20 segmented into two parts, at the curved portions, along a longitudinal section parallel to one-dot chains may be formed in a press, and welded with the curved portions butted against each other. As an alternative, as shown in FIG. 6(*b*), the tabular members 21, 22, which are segmented into two parts along a cross section parallel to the short diameter of the reinforcing member or for example, along a cross section parallel to the one-dot chain connecting the short diameter of the opening of the reinforcing member and the corner in the neighborhood of the joining between the first columnar structural member and the second structural member, are bent and welded by being butted against each other in such a manner as to form an opening. As another alternative, as shown in FIG. 6(*c*), the a-shaped portions are separated to produce two pentagonal tabular members 23, 24 and two U-shaped portions 25, 26, which are butted against and welded to each other at the positions indicated by one-dot chains.

Also, the reinforcing member according to an exemplary embodiment of the present invention may be fabricated by machining a plate material, in a press, into such a shape that the opening shown in FIG. 1 forms a bottom surface. In this case, a hole can be formed by cutting a part of the bottom surface or the front portion of the plate material machined in a press thereby to form an opening. The plate material, depending on the material and thickness thereof, may be heated before being machined in a press.

Further, it is possible to fabricate the reinforcing member according to the invention by cutting a cylindrical member 27 as shown in FIG. 7. This cylindrical member 27 is welded to the joining portion between the first columnar structural member 1 and the tabular structural member 2 in such a manner that the elliptical cross section of the cylindrical member 27 forms an opening 6 located on the side of the cylindrical member 27 far from the joining portion. Also, the cylindrical member 27 can be flattened to form an elliptical section. The cylindrical member 27 may be produced from an electric resistance welded tube or a seamless steel pipe without modification, or by pressing them into a flat shape. In the case where the reinforcing member fabricated in this way is welded to a structure with a first columnar structural member joined vertically to a tabular structural member, for example, the ridge line of the U- or V-shaped bent portion of the reinforcing member is tilted with respect to the axis of the first columnar structural member.

As shown in FIGS. 1–7, the opening, the end face and the space have a round or elliptical shape or a polygonal shape with round corners.

Figure 9:
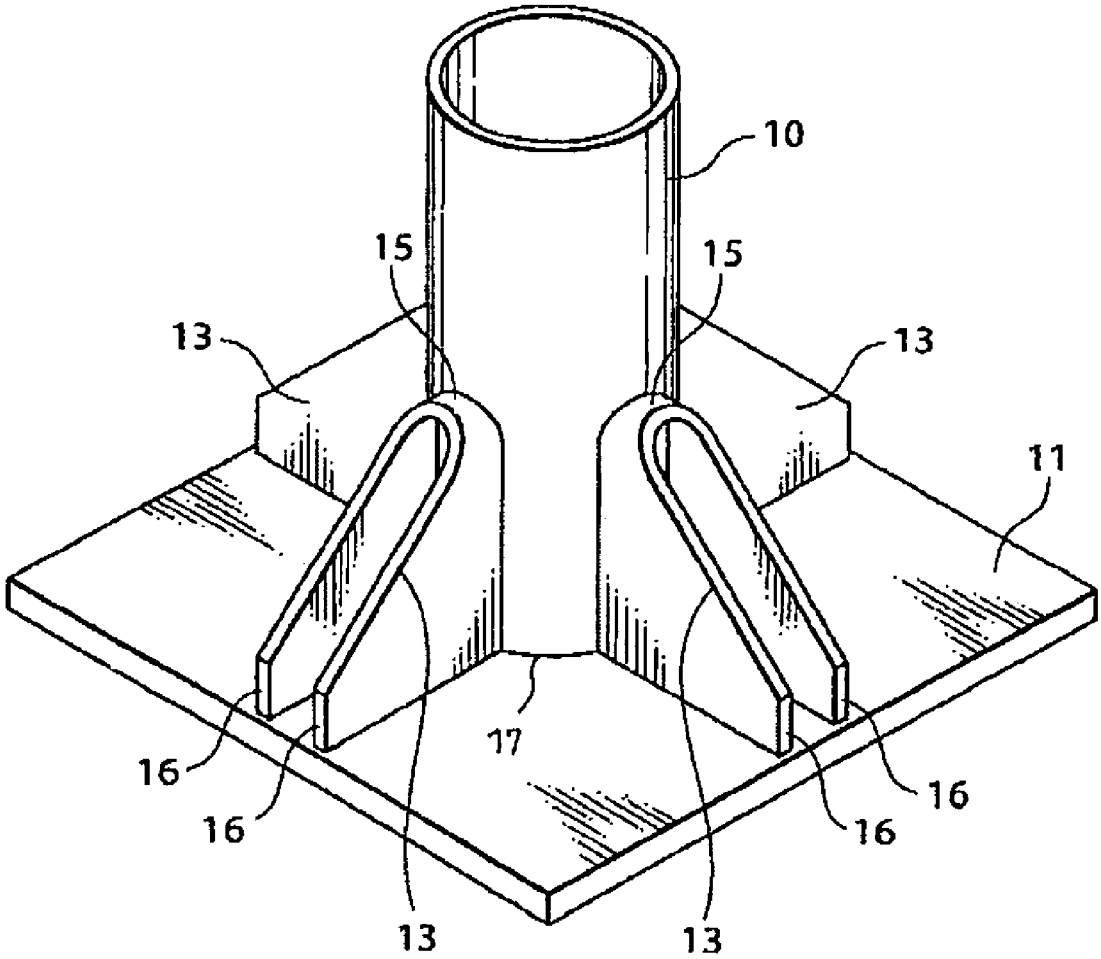
FIG. 9 is a perspective view of another conventional joining structure.

As another alternative, the reinforcing member according to a further exemplary embodiment of the present invention may be fabricated by curving the forward ends of the open end portions 16 of the conventional reinforcing member 13 shown in FIG. 9, for example, into a V-shape and welding the forward ends by being butted against each other. Specifically, the open lower forward end portions 16 formed on the side of the reinforcing member 13 not in contact with the first columnar structural member 10 and the tabular structural member 11 are curved into a U- or V-shape and welded to each other thereby to form an opening 6, which reinforcing member 10 has a U- or V-shaped curved upper end portion 15.

EXAMPLE

In the exemplary embodiment of the present invention shown in FIG. 1, the first columnar structural member 1 may have an outer diameter D of 163 mm, the columnar structural member 2 can have a thickness $t_p$ of 4.5 mm, the tabular structural member has a thickness $t_b$ of 25 mm, the reinforcing member may have a thickness $t_r$ of 6.0 mm, the length $h_p$ of the reinforcing member on the side of the first columnar structural member may be 200 mm, the length $h_b$ of the reinforcing member on the side of the tabular structural member may be 100 mm, the width W of the reinforcing member may be 40 mm, the radius of curvature $r_p$ of the reinforcing member on the side of the first columnar structural member (upper end portion) may be 40 mm, and the radius of curvature $r_b$ of the reinforcing member on the side of the tabular structural member (lower end portion) may be 40 mm. The result of an experiment conducted to apply the horizontal force as a load on the first columnar structural member 1 indicates that the proof stress is sufficiently high.

The foregoing merely illustrates the principles of the invention. Various modifications and alterations to the described embodiments will be apparent to those skilled in the art in view of the teachings herein. It will thus be appreciated that those skilled in the art will be able to devise numerous arrangements although not explicitly shown or described herein, embody the principles of the invention and are thus within the spirit and scope of the present invention. In addition, all publications cited above are incorporated herein by reference in their entireties.

What is claimed is:

1. A structure comprising:

a first columnar structural member including a first joining portion;

a second structural member including a second joining portion and coupled to the first columnar structural member such that the axes of the first columnar structural member and the second structural member cross each other; and a tabular reinforcing member configured to reinforce the first and second crossed joining portions, wherein the tabular reinforcing member is welded to the first columnar structural member and the second structural member, and wherein the tabular reinforcing member has opposing side portions and at least two bent portions which each have one of a U shape and a V shape abutting at least one surface of the first columnar structural member of the crossed joining portion and at least one surface of the second structural member each bent portion being at a distance from the junction of the first and second structural members, and the tabular reinforcing member defining an opening on the side opposite the first and second structural members of the crossed joining portion.

2. The structure according to claim 1, wherein the second structural member is a tabular member.

3. The structure according to claim 1, wherein the second structural member is a columnar member crossing the first columnar structural member.

4. The structure according to claim 1, wherein the structure comprises a plurality of the reinforcing members, where a width of the reinforcing member is from 0.7 to 0.95 times as large as a width of the first columnar structural member, and the reinforcing members are arranged at opposed positions with respect to the first columnar structural member.

5. The structure according to claim 1, further comprising a lid member arranged on the opening.

6. The structure according to claim 1, wherein the reinforcing member is produced by forming and welding two or more tabular members to one another.

7. The structure according to claim 1, wherein the reinforcing member is produced by forming a cylindrical member.

8. A structure comprising:

a first columnar structural member including a first joining portion;

a second structural member including a second joining portion and coupled to the first columnar structural member such that the axes of the first columnar structural member and the second structural member cross each other; and a reinforcing member welded to the first columnar structural member and the second structural member, wherein the reinforcing member protrudes from a surface of the first columnar structural member and a surface of the second structural member, wherein the reinforcing member has opposing side portions and at least one bent portion with at least one of a U-shaped cross section and a V-shaped cross section abutting the surface of the first columnar structural member and the surface of the second structural member on a side of the reinforcing member provided at a distance from the first and second joining portions, wherein the at least bent portion is welded to the first columnar structural member and the second structural member, and wherein the reinforcing member defines an opening on the opposite side thereof that is prevented from contacting the first columnar structural member and the second structural member.

9. The structure according to claim 8, wherein the opening is arranged in an end surface formed by an end portion of the reinforcing member that is prevented from contacting the first columnar structural member and the second structural member, and wherein the opening is a space formed by the inner edge of the reinforcing member.

10. The structure according to claim 8, wherein the second structural member is a tabular member.

11. The structure according to claim 8, wherein the second structural member is a columnar member crossing the first columnar structural member.

12. The structure according to claim 8, wherein the structure comprises a plurality of the reinforcing members, where a width of the reinforcing member is from 0.7 to 0.95 times as large as a width of the first columnar structural member, and wherein the reinforcing members are arranged only at opposed positions with respect to the first columnar structural member.

13. The structure according to claim 8, further comprising a lid member arranged on the opening.

14. The structure according to claim 8, wherein the reinforcing member is produced by forming and welding two or more tabular members to one another.

15. The structure according to claim 8, wherein the reinforcing member is produced by forming a cylindrical member.

16. A structure comprising:

a first columnar structural member;

a plurality of second columnar structural members wherein the first columnar member and the plurality of second columnar structural members are coupled such that the axes of the first columnar member and the second columnar structural members cross each other; and a reinforcing member welded to two of the second columnar structural members, wherein the reinforcing member protrudes from a surface of the two of the second columnar structural members, and has opposing side portions and a bent portion with one of a U-shaped cross section and a V-shaped cross section abutting the surface of the two of the second columnar structural members on a side of the reinforcing member provided at a distance from the joining portion of the two of the second columnar structural members and the first columnar structural member, wherein the bent portion is welded to the two of the second columnar structural members, and wherein the reinforcing member defines an opening on the opposite side thereof that is prevented from contacting the two of the second columnar structural members and the first columnar structural member.

17. The structure according to claim 16, wherein the opening is arranged in an end surface formed by an end portion of the reinforcing member that is prevented from contacting the two of the second columnar structural members and the first columnar structural member, and wherein the opening is a space formed by an inner edge of the reinforcing member.

18. The structure according to claim 16, wherein the opening is arranged in an end surface formed by an end portion of the reinforcing member that is prevented from contacting the two of the second columnar structural members and the first columnar structural member, and wherein a long diameter of the opening is from 0.5 to less than 1.0 times as large as a long diameter of the end surface.

19. The structure according to claim 16, wherein a width of the reinforcing member is from 0.7 to 0.95 times as large as a width of the second columnar structural members.

20. The structure according to claim 16, wherein a lid member is arranged on the opening.

21. The structure according to claim 16, wherein the reinforcing member is produced by forming and welding two or more tabular members to each other.

22. The structure according to claim 16, wherein the reinforcing member is produced by forming a cylindrical member.

* * * * *